US007793530B2

(12) United States Patent
Straka

(10) Patent No.: US 7,793,530 B2
(45) Date of Patent: Sep. 14, 2010

(54) DURABLE ENLARGED FORMING TOOL TECHNOLOGY

(75) Inventor: Gordon A. Straka, Afton, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 501 days.

(21) Appl. No.: 11/756,919

(22) Filed: Jun. 1, 2007

(65) Prior Publication Data

US 2008/0295562 A1 Dec. 4, 2008

(51) Int. Cl.
*B21D 28/00* (2006.01)

(52) U.S. Cl. ..... 72/332; 72/412; 72/446; 72/475

(58) Field of Classification Search ..... 72/325, 72/326, 332, 333, 412, 413, 442, 444, 446, 72/462, 475, 481.3, 481.8, 478; 83/686, 83/698.91; 29/568; 483/1, 29
See application file for complete search history.

(56) References Cited

U.S. PATENT DOCUMENTS

| | | | | |
|---|---|---|---|---|
| 1,053,476 | A | 2/1913 | Brown | |
| 1,680,650 | A | 8/1928 | Travis | |
| 2,124,923 | A | 7/1938 | LeJeune | |
| 2,728,316 | A | 12/1955 | Oberg | |
| 2,937,687 | A | 5/1960 | Gould | |
| 3,060,994 | A | 10/1962 | Larsen | |
| 3,314,276 | A | 4/1967 | Peyton | |
| 3,656,392 | A * | 4/1972 | Krynytzky et al. | 83/530 |
| 3,803,896 | A | 4/1974 | Cermak | |
| 3,890,869 | A * | 6/1975 | Van Cleave | 83/559 |
| 3,943,744 | A | 3/1976 | Marsh | |
| 3,971,244 | A | 7/1976 | Zengerer | |
| 4,519,235 | A | 5/1985 | Gauck | |
| 5,007,282 | A * | 4/1991 | Bakermans | 72/481.8 |
| 5,392,629 | A | 2/1995 | Goss | |
| 5,669,866 | A * | 9/1997 | Julian et al. | 483/1 |
| 5,778,721 | A | 7/1998 | Klingel | |
| 6,134,938 | A * | 10/2000 | Ohtsuka | 72/328 |
| 6,189,361 | B1 | 2/2001 | Seki | |
| 6,334,381 | B1 * | 1/2002 | Chatham | 83/588 |
| 6,959,582 | B2 | 11/2005 | Peterhansel | |
| 2003/0188564 | A1 | 10/2003 | Wade | |

FOREIGN PATENT DOCUMENTS

| | | | |
|---|---|---|---|
| DE | 200 20 500 | U1 | 3/2001 |
| JP | 2002-126830 | A | 5/2002 |
| JP | 2003-230920 | A | 8/2003 |
| JP | 2006-142318 | A | 6/2006 |

OTHER PUBLICATIONS

International Search Report and Written Opinion, dated Aug. 12, 2008 for PCT Application No. PCT/US2008/061996, 12 pages.
English language abstract for JP 2006-142318 (Amada Co., Ltd.).
English language abstract for JP 2003-230920 (Murata Machinery, Ltd.).
English language abstract for JP 2002-126830 (Amada Eng. Ct. Co. Ltd.).

* cited by examiner

*Primary Examiner*—Edward Tolan
(74) *Attorney, Agent, or Firm*—Fredrikson & Byron, P.A.

(57) ABSTRACT

The invention involves a forming tool for a machine tool. The forming tool can be used, for example, to create various large forms in sheet metal or other workpieces.

56 Claims, 15 Drawing Sheets

DURABLE ENLARGED FORMING TOOL TECHNOLOGY

FIELD OF THE INVENTION

The present invention is in the field of tools for machine tools. More particularly, this invention relates to forming tools for machine tools.

BACKGROUND OF THE INVENTION

Machine tools are widely used to form sheet metal and other workpieces into various configurations using cooperating upper and lower tools. In some cases, an upper tool mounted in a tool holder of the machine tool is moved downwardly against a workpiece disposed on a die, which cooperates with the upper tool. Some dies have resiliently moveable portions that facilitate forming the workpiece about contours of the tools. Tooling of this nature may deform the workpiece by simply providing a contour, in which case the cooperating surfaces of the tools will generally have radiused edges. Other tooling cuts through the workpiece. Such tools typically have sharp cooperating edges to shear the workpiece. Some tooling provides both forming and cutting action, for example, by having forming edges about a portion of the periphery and cutting edges about the remainder of the periphery.

Generally, machine tools have a limitation as to the maximum size (e.g., the maximum diameter) of the tools that can be used. If the diameter of a conventional forming tool is smaller than the length of the desired form, then multiple operations may be required to create the full length of the form. This is inefficient and costly and it may require using multiple tools (or even multiple machine tools) to obtain the desired form.

Some expandable form tools have been devised to make forms having a length greater than the diameter of the tool's main body. However, the expandability of those tools causes some inherent weakness.

It would be desirable to provide a forming tool that can create a form larger than the normal diameter of a conventional forming tool, e.g., such that a large form can be produced in a single stroke. It would be particularly desirable to provide a forming tool of this nature that is durable in terms of withstanding breakage over long periods of rigorous use.

SUMMARY OF THE INVENTION

In the present invention, certain embodiments provide a forming tool adapted for being mounted removably on a machine tool. In the present embodiments, the forming tool comprises a mount portion, a tool body, and an elongated forming platform. The mount portion is adapted for being retained by a tool holder of the machine tool. The tool body has a front section and a rear section. In the present embodiments, the mount portion projects from the tool body's rear section, and the elongated forming platform extends from the tool body's front section. The elongated forming platform is adapted to engage and forcibly deform a workpiece by creating a desired form in the workpiece. In the present embodiments, the tool body has a first crosswise major dimension, the elongated forming platform has a second crosswise major dimension, and the second crosswise major dimension is greater than the first crosswise major dimension. Preferably, the elongated forming platform is rigidly disposed relative to the tool body, e.g., such that throughout forming operations the elongated forming platform and the tool body are restrained against any significant movement relative to each other.

Some embodiments of the invention provide a forming tool adapted for being mounted removably on a machine tool having a punch-mounting position, a die-mounting position, and a stripper-mounting position. In the present embodiments, the forming tool comprises: a mount portion configured for being operatively retained in an upper portion of the machine tool's punch-mounting position; a tool body configured for being operatively retained in a lower portion of the machine tool's punch-mounting position; and an elongated forming platform configured for being located in the machine tool's stripper-mounting position. Preferably, the tool body has a front section and a rear section, and the mount portion projects from the tool body's rear section. The elongated forming platform is adapted to engage and forcibly deform a workpiece by creating a desired form in the workpiece.

Some embodiments of the invention provide a combination including a machine tool and a forming tool. In certain combination embodiments, the forming tool is mounted removably on the machine tool. Commonly, the machine tool comprises: a workpiece position; a ram assembly above the workpiece position, and; a die holder assembly below the workpiece position. In some cases, the ram assembly has a punch-mounting position and a stripper-mounting position, while the die holder assembly has a die-mounting position. This arrangement, however, can optionally be reversed. In the present embodiments, the forming tool comprises: a mount portion retained in an upper portion of the machine tool's punch-mounting position; a tool body retained in a lower portion of the machine tool's punch-mounting position; and an elongated forming platform located in the machine tool's stripper-mounting position. Here, the tool body has a front section and a rear section, and the mount portion projects upwardly from the tool body's rear section. The elongated forming platform is adapted to engage and forcibly deform a workpiece by creating a desired form in the workpiece.

The invention also provides embodiments involving a method of fabricating a sheet-like workpiece (optionally a sheet-like metal workpiece, such as a piece of sheet metal). Here, the method comprises providing a machine tool, a forming tool, and the workpiece. In some of the present methods, the machine tool has: a workpiece position where the sheet-like workpiece is located; a ram assembly above the workpiece position, and; a die holder assembly below the workpiece position. Commonly, the ram assembly has a punch-mounting position and a stripper-mounting position, and the die holder assembly has a die-mounting position. In the present embodiments, the forming tool is mounted removably on the machine tool, and the ram assembly is adapted to move the forming tool (e.g., downwardly) into contact with the workpiece. Here, the forming tool has: a mount portion retained in an upper portion of the machine tool's punch-mounting position; a tool body retained in a lower portion of the machine tool's punch-mounting position, and; an elongated forming platform located in the machine tool's stripper-mounting position (at least when the ram assembly is at rest). The present method comprises operating the machine tool so as to actuate the ram assembly, thereby moving the forming tool (e.g., downwardly) into contact with the sheet-like workpiece such that the forming tool's elongated forming platform forcibly deforms the workpiece by creating a desired form in the workpiece. In some of the present embodiments, the tool body has a front section and a rear section, and the mount portion projects upwardly from the tool body's rear section

DETAILED DESCRIPTION OF PREFERRED EMBODIMENTS

Figure 1:
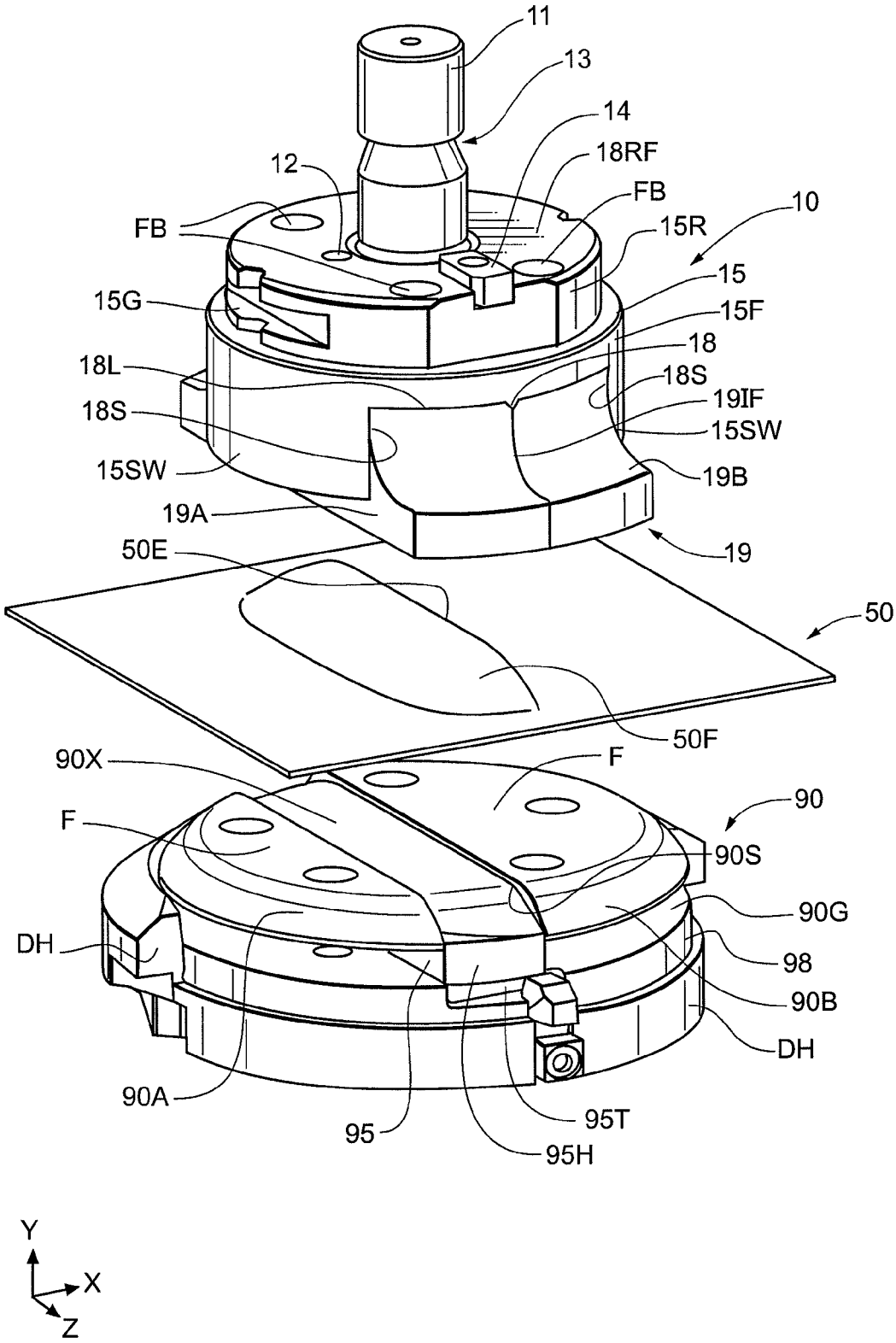
FIG. 1 is an exploded perspective view of a tool set and workpiece in accordance with certain embodiments of the present invention.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the given examples have many useful alternatives, which fall within the scope of the invention.

The present invention provides a forming tool that is adapted for being mounted removably on a machine tool (e.g., a metal-fabrication machine tool). The terms "forming tool," "forming," "form" and the like are used herein to describe tools that merely form the workpiece into a desired contour, as well as tools that combine forming and cutting actions.

The present forming tool can create exceptionally large forms. Yet the tool is extremely durable. The tool's configuration allows it to avoid breakage over an extended period of rigorous use.

Figure 2:
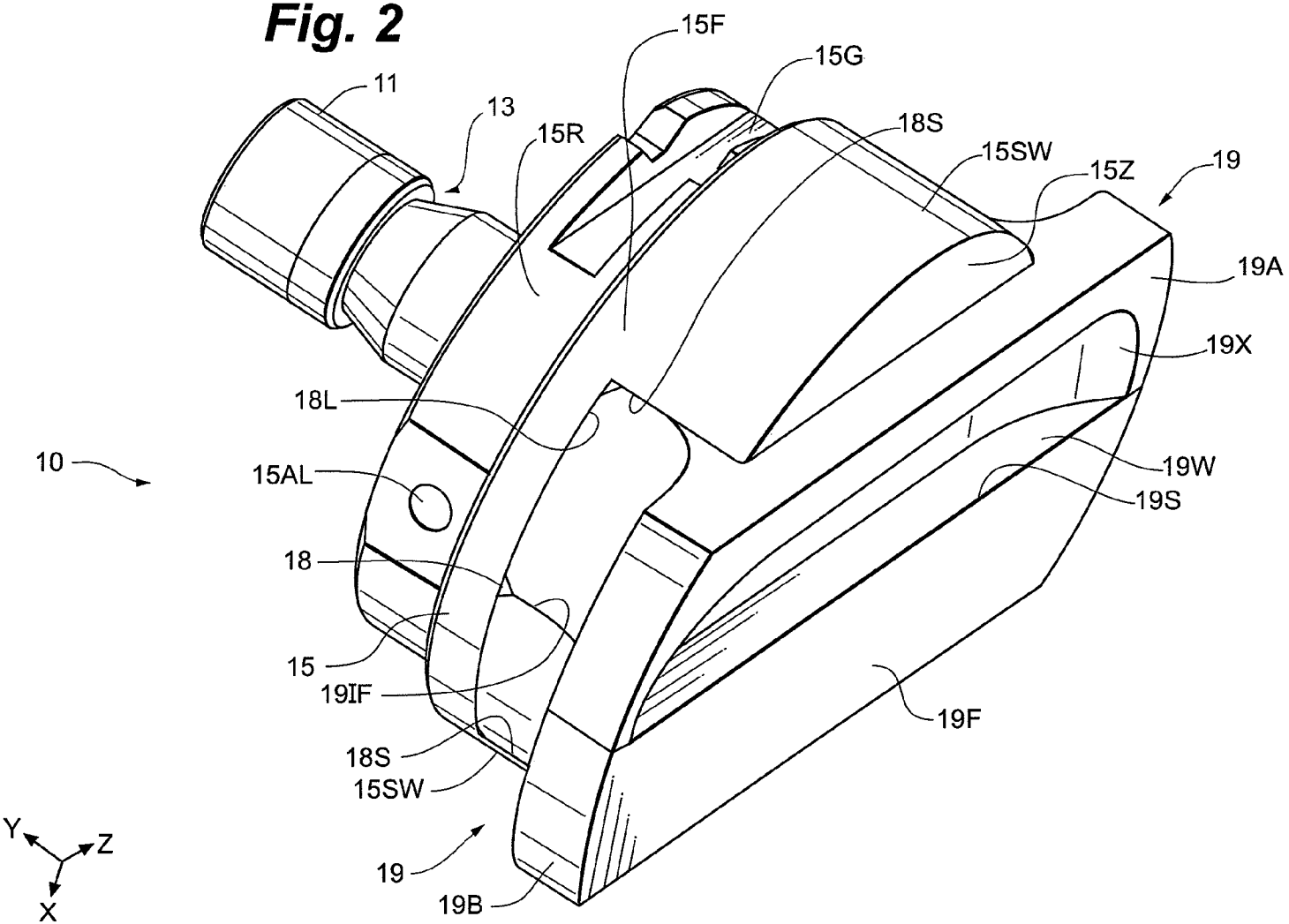
FIG. 2 is a perspective view of a forming tool in accordance with certain embodiments of the invention.

The forming tool 10 has a tool body 15 and an elongated forming platform 19. Reference is made to FIG. 2, which depicts one exemplary embodiment. Here, the tool body 15 has a front section 15F and a rear section 15R. During use, the front section 15F is closer to the workpiece than the rear section 15R. In the illustrated embodiments, the rear section 15R has a smaller perimeter (e.g., a smaller diameter) than the front section 15F. This is a desirable design feature. However, it is not required in all embodiments. For example, the front 15F and rear 15R sections have substantially the same perimeter (e.g., the same diameter) in another group of embodiments.

The elongated forming platform 19 is adapted to engage and forcibly deform a workpiece 50 by creating a desired form 50F in the workpiece. This is perhaps best appreciated by referring to FIGS. 1, 11, and 12. These figures exemplify embodiments where the tool 10 is configured such that when the forming platform 19 engages and forcibly deforms the workpiece 50, the form 50F created in the workpiece is selected from the group consisting of a louver, a lance & form, and a card guide. These particular forms, however, are not limiting examples. Rather, the tool 10 can be adapted for making a wide variety of other forms.

In one advantageous group of embodiments, the tool 10 is configured such that when the elongated forming platform 19 engages and forcibly deforms the workpiece, the form 50F created in the workpiece has a major dimension (such as a length, e.g., measured parallel to a planar face of the workpiece) of greater than 3½ inches, greater than 3.65 inches, or even greater than 3¾ inches. In one embodiment, the tool 10 is configured to create a form 50F having a length of about 4 inches or more.

In certain embodiments, the front of the tool's enlarged forming platform has at least one recess into which the workpiece is deformed during a forming operation. In some embodiments of this nature, the recess (in some cases, each such recess) has a major dimension within one or more of the ranges noted in the preceding paragraph.

Even though the present forming tool is configured to create very large forms, it is extremely durable. The design of the tool eliminates inherent fragilities associated with prior art designs. As a result, the tool is robust. It is not prone to breaking early in its lifetime, but rather provides service over an extended period of time.

One feature enhancing the durability of the present tool 10 is that the elongated forming platform 19 is rigidly disposed relative to the tool body 15 such that, throughout forming operations, the elongated forming platform and the tool body are restrained against any significant movement relative to each other. Thus, the forming platform and the tool body preferably do not move relative to one another during forming operations (e.g., during the down-stroke or up-stroke of a ram, which may be used to force the tool against a workpiece).

In one group of embodiments, the front section 15F of the tool body 15 has a transversely extending channel 18 in which the elongated forming platform 19 is mounted (e.g., rigidly). In the illustrated designs, the tool body 15 has (e.g., defines) two sidewalls 15SW and a back wall 18L that bound (and together define) the channel 18. The illustrated channel 18 extends entirely across the tool body 15. In some cases, the tool body has a diameter, and the channel 18 opens diametrically entirely through (i.e., all the way between opposed sides of) the tool body 15. These features, however, are not required in all embodiments. For example, the channel can be omitted and a male extension (e.g., a square stem) of the forming platform can be rigidly mounted in a corresponding female recess defined by the tool body. As another alternative, the forming platform can simply be bolted flush against a planar end face of the tool body. Many other variations can be used as well.

Thus, in certain embodiments, the elongated forming platform 19 comprises a block 19B that is discrete from, rather than integral to, the tool body 15. This is not strictly required. For instance, a single integral block can alternatively define both the tool body 15 and the elongated forming platform 19.

In cases where the forming platform 19 comprises a block 19B discrete from the tool body 15, the platform can optionally be secured (e.g., anchored) rigidly to the tool body in a removable manner. Embodiments of this nature allow different forming platforms to be used selectively with a single tool body 15. For example, one platform 19 may be adapted to create one type of form 50F in the workpiece 50, and that platform can be removed from the tool body 15 after which the tool body can be equipped with a new forming platform adapted to create another type of form in the workpiece. As noted above, certain embodiments of this nature involve a transversely extending channel 18. However, many other useful configurations will be apparent to skilled artisans given the present teaching as a guide.

Further, if the forming platform 19 is a block 19B discrete from the tool body 15, then the forming platform may be formed of a different (optionally harder) material than the tool body. For instance, the forming platform can be a tool steel such as M2, D2 or A8, and the tool body can be a 4130 prehard, etc. These are merely examples; other suitable materials can be used.

Figure 8:
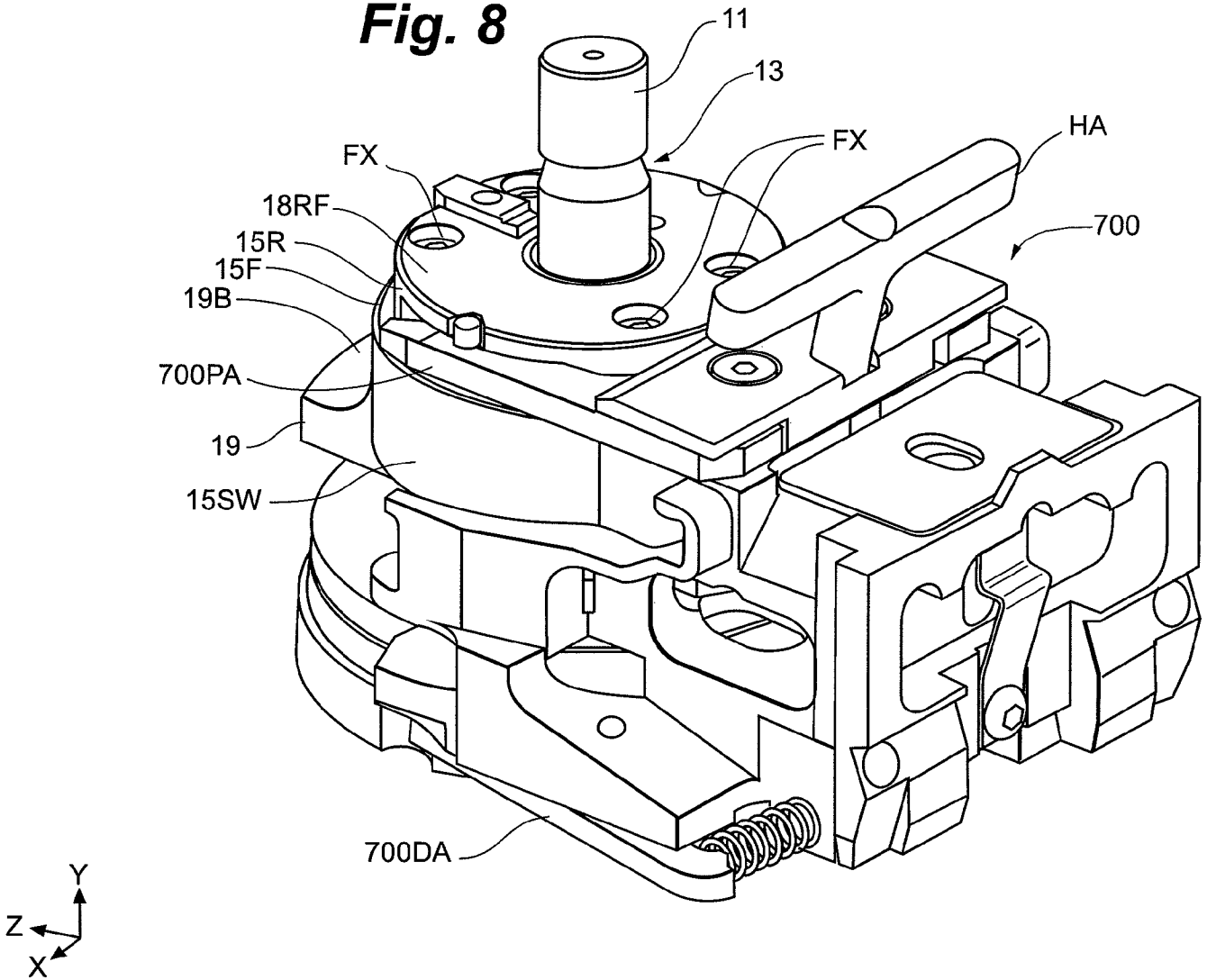
FIG. 8 is still another perspective view of the tool set and cartridge of FIG. 6.
Figure 9:
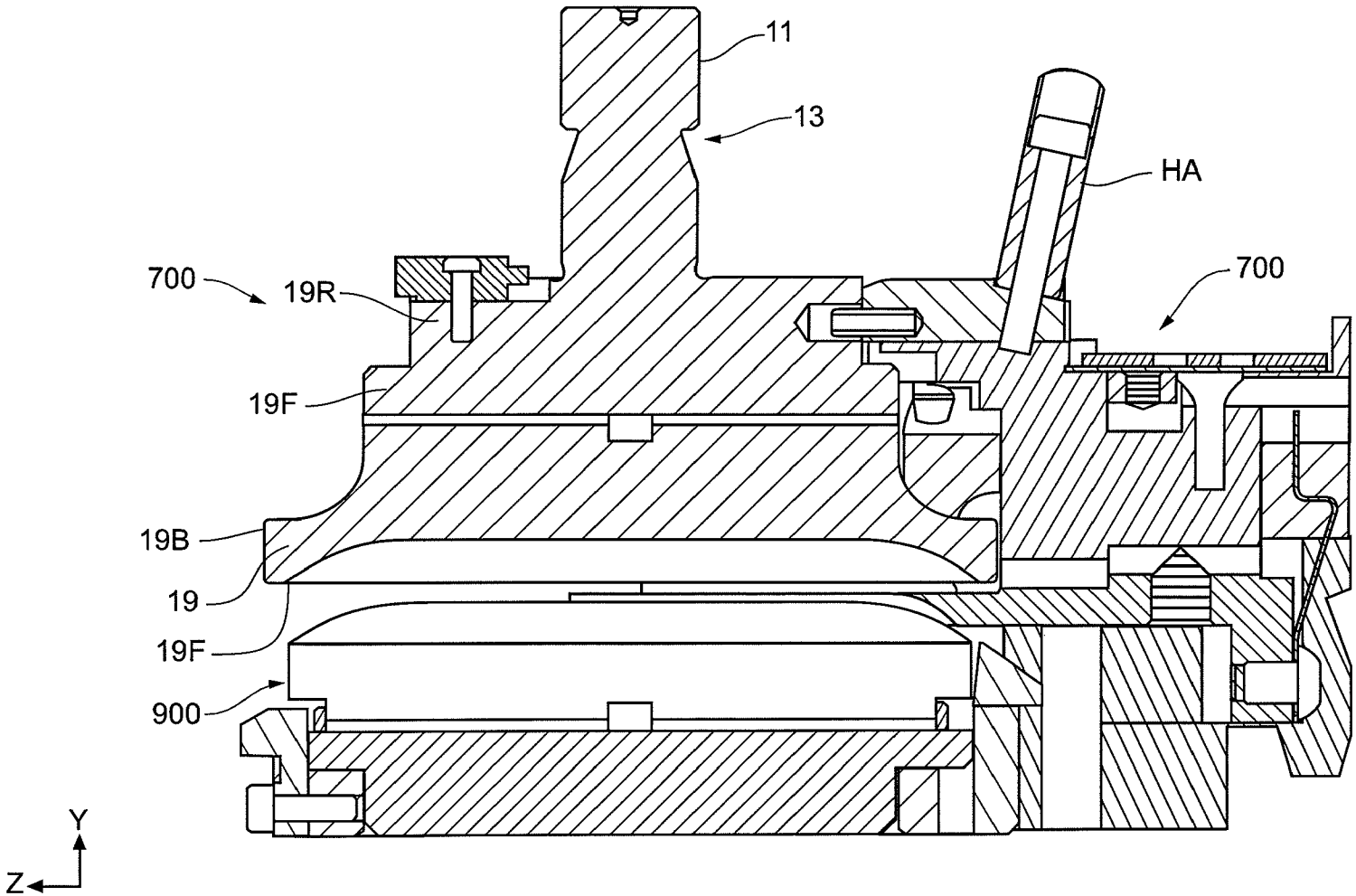
FIG. 9 is a schematic cross-sectional side view of the tool set and cartridge of FIG. 6.
Figure 10:
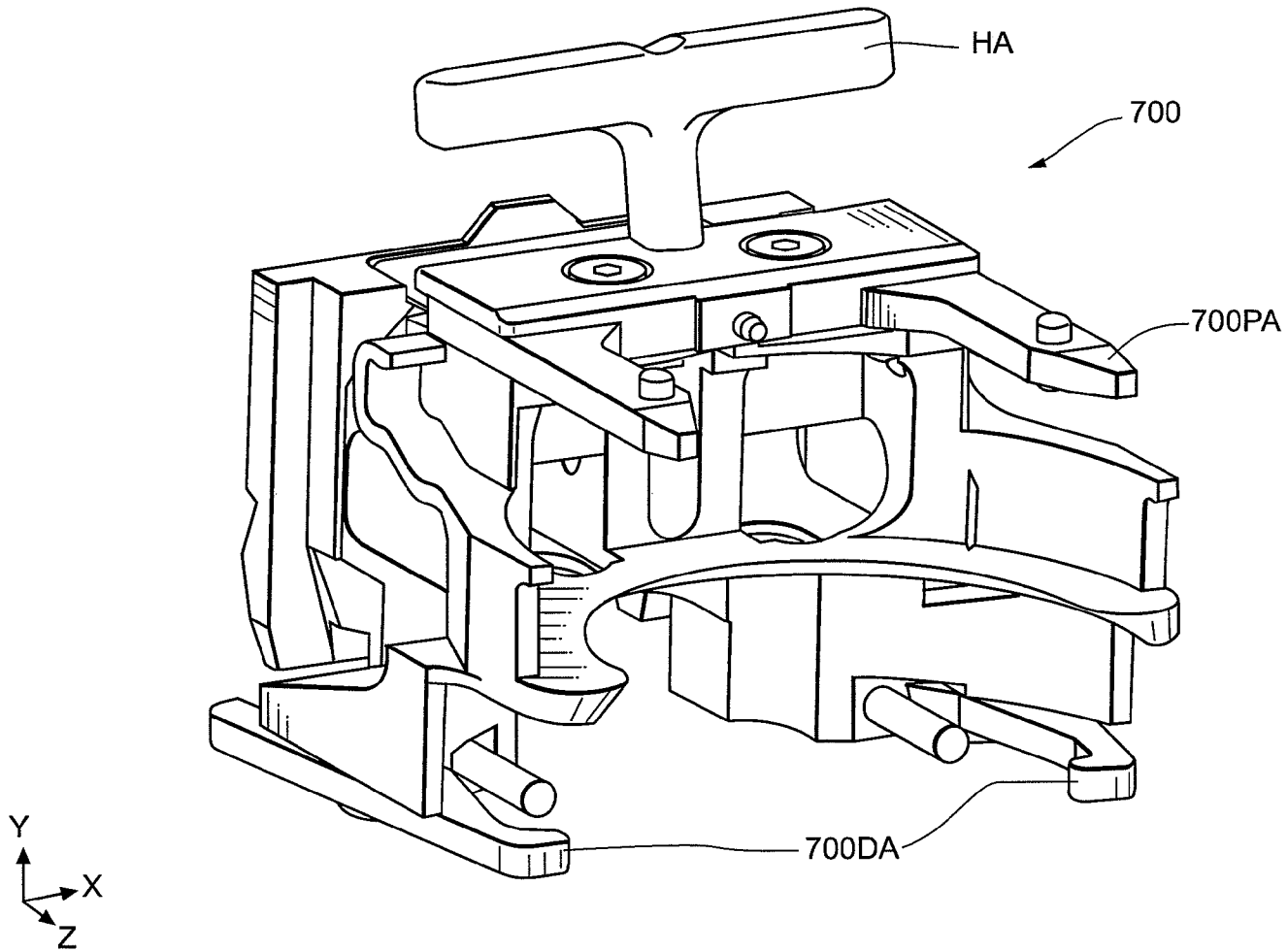
FIG. 10 is a perspective view of the holder cartridge of FIG. 6, with the cartridge shown in an unloaded state.

In the illustrated embodiments, the elongated forming platform 19 is secured (e.g., anchored) rigidly to the tool body 15 by a plurality of fasteners FX extending between the forming platform and the tool body. Reference is made to FIG. 8. The fasteners FX, for example, can be inserted through fastening bores FB (which may open through a rear face 18RF of the tool body's rear portion 18R) and secured to the elongated forming platform 19. Conventional bolts or the like can be used. If desired, a single fastener may be used (not shown), rather than multiple fasteners.

The elongated forming platform 19 preferably extends (or "projects") from the front section 15F of the tool's body. In one group of embodiments, the tool body 15 has a first crosswise major dimension (e.g., a first diameter and/or a first length), the elongated forming platform 19 has a second crosswise major dimension (e.g., a second diameter and/or a second length), and the second crosswise major dimension is greater than the first crosswise major dimension (optionally by at least ½ inch, or by at least ¾ inch, such as by about 1 inch or more). The tool body, for example, can optionally comprise a generally cylindrical block (and/or it can have a generally cylindrical portion), such that the "first crosswise major dimension" is a diameter of the cylindrical block (and/or the cylindrical portion). In these embodiments, the "second crosswise major dimension" can be a length (which may also be a diameter) of the elongated forming platform 19, in which case this length preferably is greater than the diameter of the cylindrical block. In some embodiments of this nature, the length (and/or a diameter) of the elongated forming platform 19 is greater than the diameter of the cylindrical block by at least ½ inch, or by at least ¾ inch, such as by about 1 inch or more.

In some embodiments, the elongated forming platform 19 has a length, and the forming tool 10 is adapted to create a form 50F having a major dimension at least generally parallel to the length of the forming platform. In the illustrated embodiments, the elongated forming platform 19 is a generally rectangular block. Here, the block 19B has a partial-cylinder configuration (with a diameter larger than that of the tool body's front section). Thus, the "second crosswise major dimension" here is both a length and a diameter of the block 19B. This, however, is by no means limiting. Rather, many other configurations can be used. For example, the block 19B can have a proper rectangle shape, an oval shape, an irregular shape, etc.

Preferably, the front section 15F of the tool body 15 has a leading surface 15Z that faces the workpiece 50 during forming operations. The elongated forming platform 19 has a front surface 19F that contacts the workpiece 50 during forming operations. In one group of embodiments, the elongated forming platform 10 is a thrust-out platform such that its front surface 19F is spaced forwardly of the tool body's leading surface 15Z. In embodiments of this nature, the front surface 19F of the forming platform can, for example, be spaced forwardly of the tool body's leading surface 15Z by at least 1/16 inch, or by at least 3/16 inch, such as by about ¼ inch or more.

The front of the forming platform 19 can take many different forms depending on the configuration of the desired form. In one group of embodiments, surface 19F is a substantially planar surface (defined by one or more bodies making-up the forming platform) substantially or entirely surrounding at least one forming recess in the front of the forming platform. This, however, will not be the case for all embodiments.

The forming tool 10 preferably has a mount portion 11 adapted for being retained by a tool holder of a machine tool. In some embodiments, the mount portion 11 projects from the tool body's rear section 15R. The mount portion 11 can optionally be a mounting stem. For example, the tool 10 can have a mounting stem comprising a post projecting from the tool body's rear section 15R to a terminal end. To facilitate retention of such a post by the tool holder of the machine tool, a mounting notch 13 may be formed in the post (e.g., so as to extend entirely about the perimeter of the post). In the illustrated embodiments, the tool body 15 and the mount portion 11 are both defined by a single integral block. This, however, is not required.

The rear section 15R of the illustrated tool body 15 has two opposed sides with holding grooves 15G formed therein. These grooves 15G are configured to receive respective arms of a holder cartridge (which is adapted to retain the forming tool and a corresponding die at times when the tool set is not actually being used by the machine tool, such as when the loaded cartridge is stored on the rail of a rail-style machine tool). The illustrated grooves 15G, however, are optional, and need not be provided in all embodiments.

FIGS. 6-10 and 17 depict an exemplary holder cartridge. The illustrated cartridge 700 has punch-retention arms 700PA, die-retention arms 700DA, and an optional handle HA. The cartridge 700 can be generally like those described in U.S. patent application Ser. No. 11/355,792, the contents of which are incorporated herein by reference. To accommodate the elongated forming platform 19 of the present tool 10, the cartridge has been redesigned such that the rim projecting inwardly from the stripper locator base has been shortened, or even removed, and/or the cartridge has been otherwise modified. For example, in FIG. 10 of the present disclosure, the stripper latch has been omitted, and the diameter above the stripper ledge has been increased, to accommodate the elongated forming platform of the present forming tool.

Figure 3:
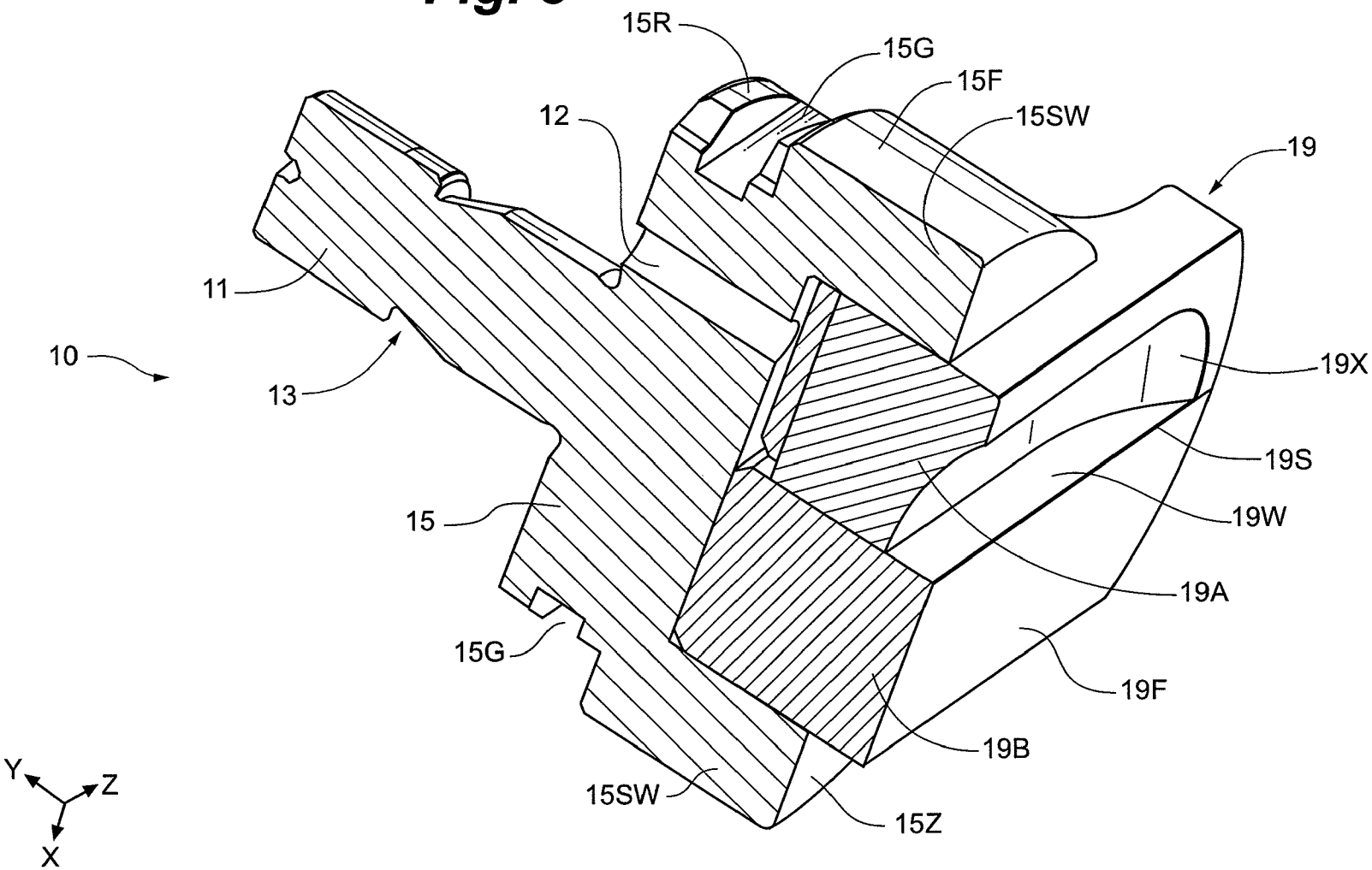
FIG. 3 is a perspective view of a cross-section of the forming tool of FIG. 2.
Figure 4:
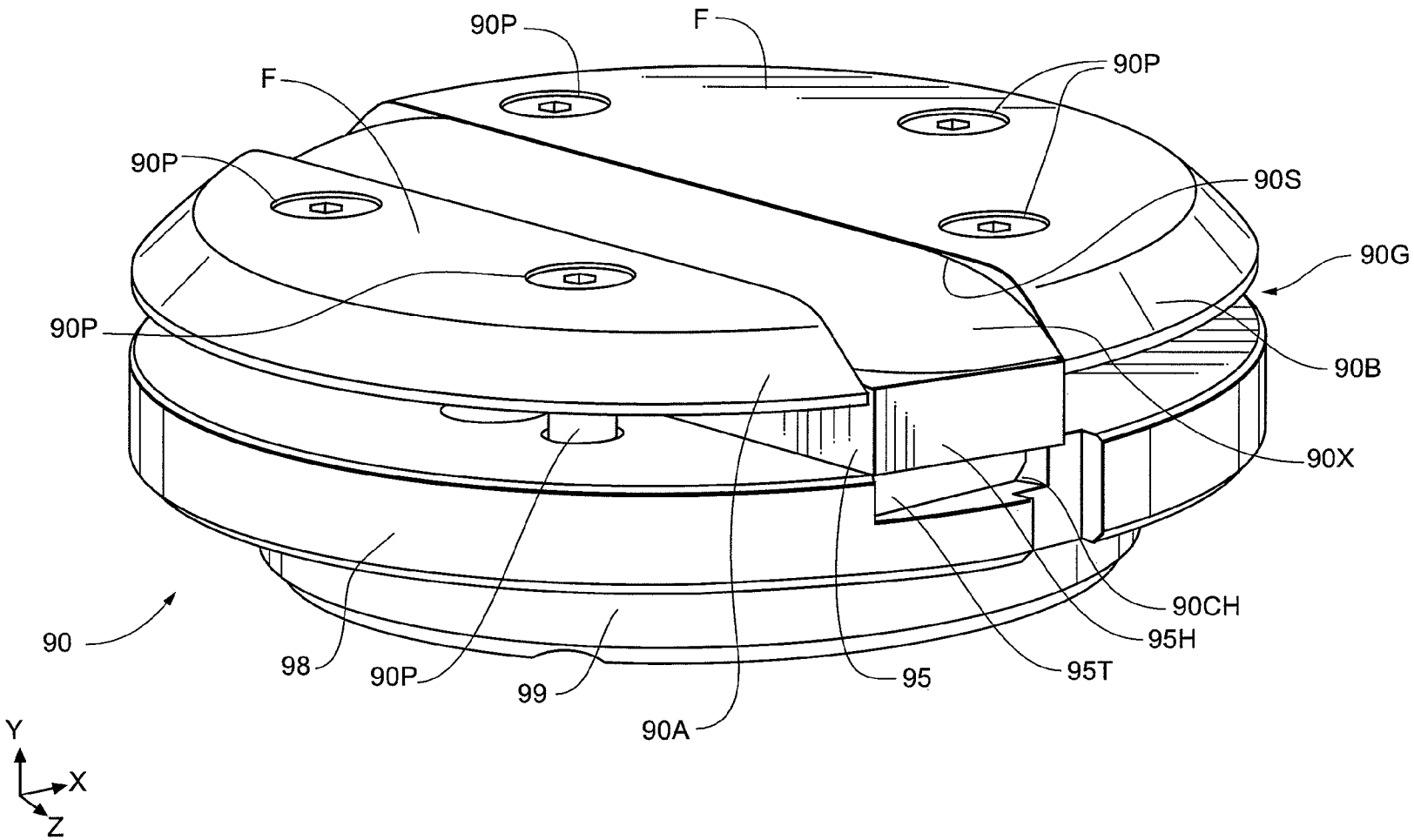
FIG. 4 is a perspective view of a die adapted for use in certain embodiments of the invention.
Figure 5:
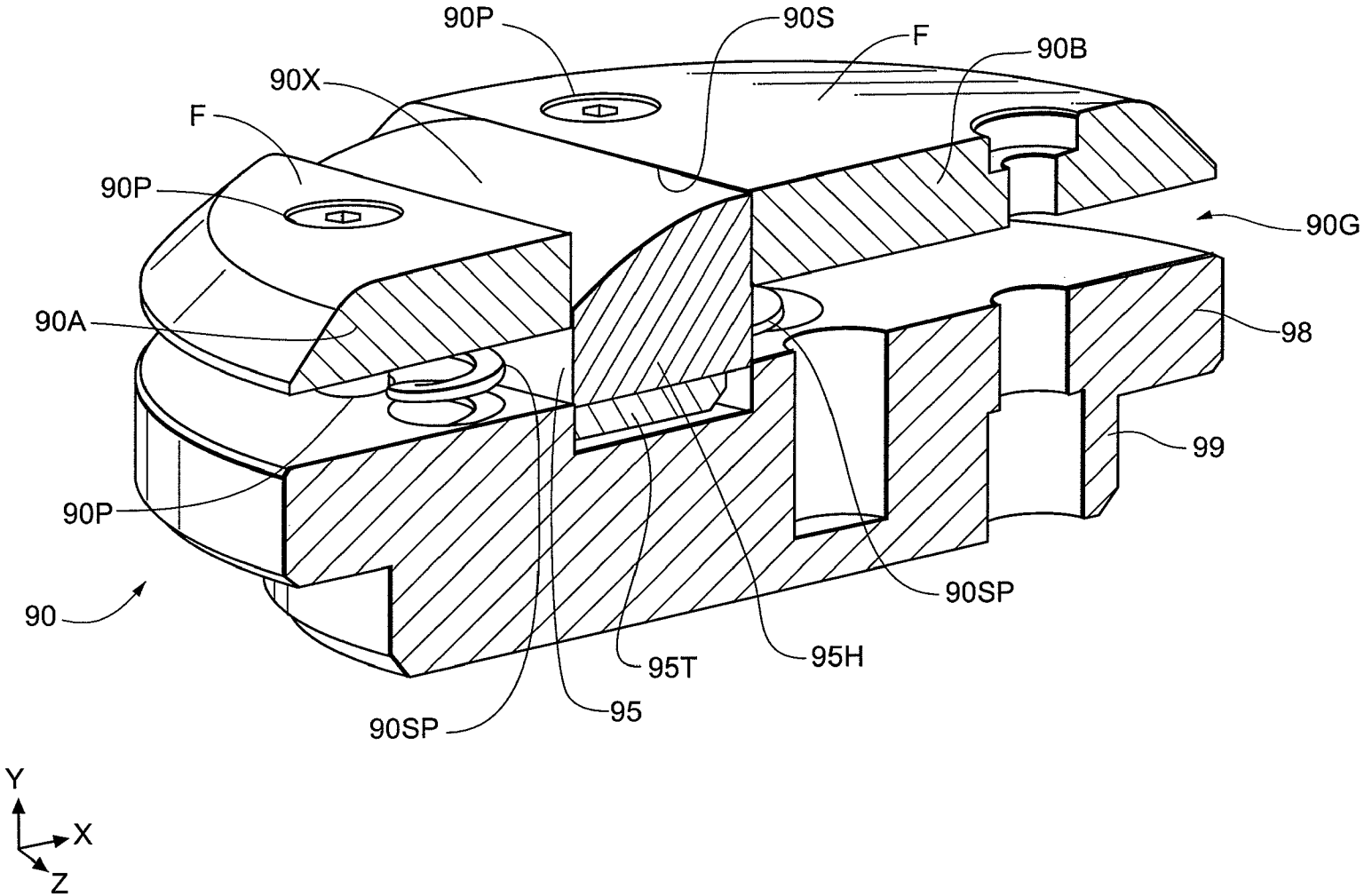
FIG. 5 is a perspective view of a cross-section of the die of FIG. 4.
Figure 6:
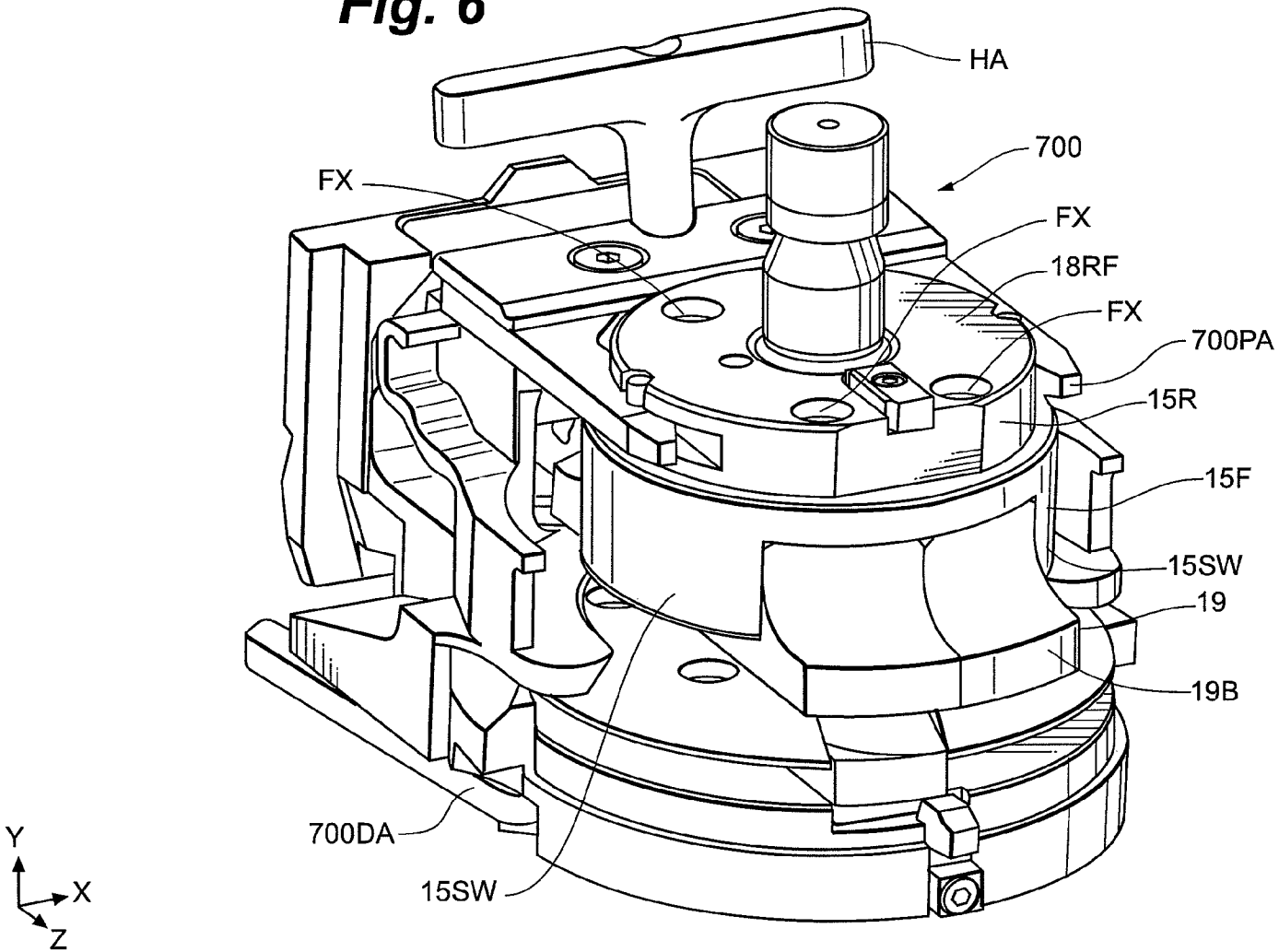
FIG. 6 is a perspective view of a tool set retained on a holder cartridge in accordance with certain embodiments of the invention.
Figure 7:
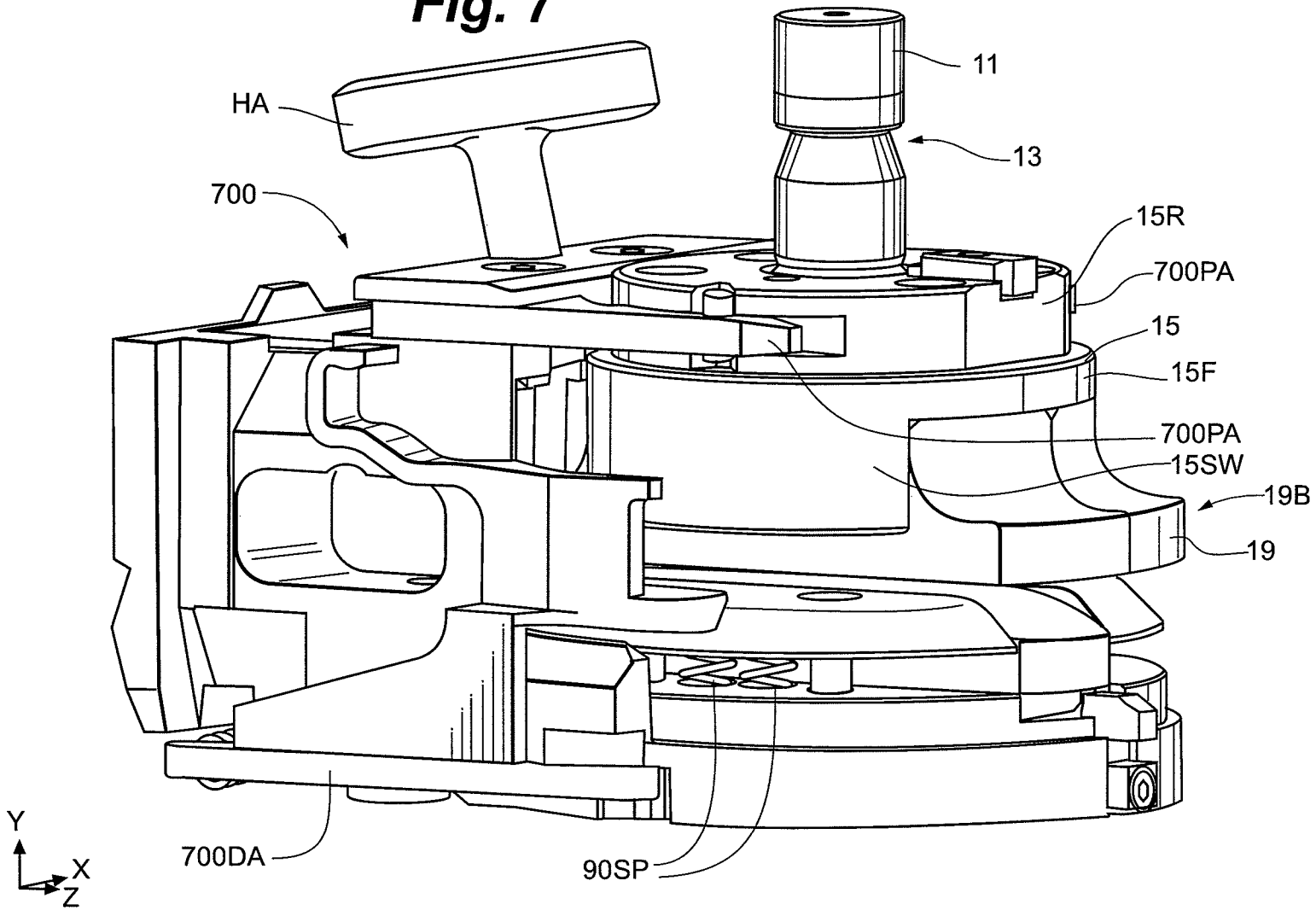
FIG. 7 is another perspective view of the tool set and cartridge of FIG. 6.

In some cases, a single integral block defines both the front 15F and rear 15R sections of the tool body 15. Reference is made to FIG. 3. Here, the rear section 15R has a generally cylindrical configuration with a first diameter, the front section 15F has a generally cylindrical configuration with a second diameter, and the first diameter is smaller than the second diameter. Thus, the rear section 15R of the illustrated tool body 15 has a smaller cylindrical configuration than the front section 15F. As already explained, this is not required in all embodiments.

In cases where the elongated forming platform 19 has a partial-cylinder configuration with a diameter (or another configuration having a diameter), that diameter can advantageously be larger than a diameter of the tool body's front section 15F. (It is to be understood, though, that the tool body 15 need not be configured so as to have a front section with a diameter. For example, the front section of the tool body can be square, etc.). Additionally or alternatively, the mount portion 11 of the tool 10 can optionally have a diameter that is smaller than a diameter of the tool body's rear section 15R. (As with the tool body's front section, the rear section need not be configured so as to have a diameter.) While the noted features are used advantageously in some embodiments, they are not required in all embodiments: so, they are optional. For instance, in embodiments where the forming tool 10 has a mount portion 11, the mount portion need not have a diameter. Instead, it can have a polygonal cross-section, such as a square cross-section, an irregular cross-section, etc.

FIGS. 1-9 depict exemplary embodiments where the tool 10 is adapted to form a louver in a workpiece. Here, the front section 15F of the tool body 15 has a transversely extending channel 18, and the elongated forming platform 19 comprises two bodies (optionally metal bodies) carried alongside each other. Both of these bodies are rigidly mounted in the transversely extending channel 18 such that confronting sides of the bodies are adjacent to (e.g., are in contact with) each other. The confronting side of one of the bodies defines a shearing edge and bounds a generally concave louver recess formed in the other body. These features, however, are merely exemplary-they are not required in other embodiments. For example, the tool 10 can be adapted to create many other forms. Also, the configuration of the tool 10 can be different even for other embodiments of a louver tool. For instance, the elongated forming platform 19 can be defined by a single block, rather than two blocks. Three or more blocks could also be used to define the elongated forming platform 19. Further, if desired, the platform 19 can extend further about (optionally all the way around) the perimeter of the tool body 15. Many other variations will be apparent to skilled artisans given the present teaching as a guide.

In one group of embodiments, the invention takes advantage of the space where a stripper plate is normally mounted on a machine tool. This is best understood by referring first to FIGS. 13-16 (which exemplify use of a holder cartridge to load a prior art tool set onto a machine tool), and then to FIGS. 17 and 18 (which respectively show use of a holder cartridge to load a tool set on a machine tool, and a combination involving a forming tool operatively mounted on the machine tool, in accordance with selected embodiments of the invention).

Figure 17:
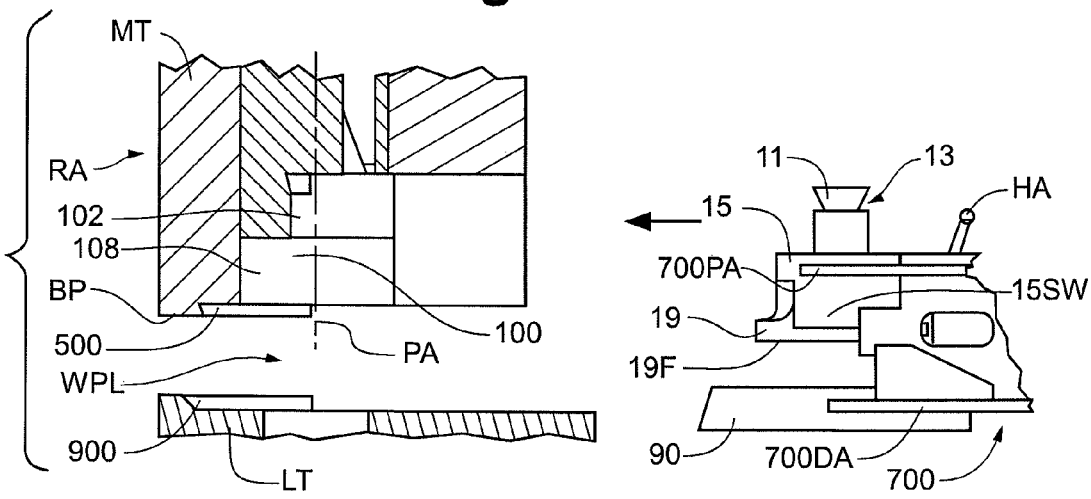
FIG. 17 is a partially broken-away cross-sectional side view exemplifying use of a holder cartridge to load a tool set onto a machine tool in accordance with certain embodiments of the invention.
Figure 18:
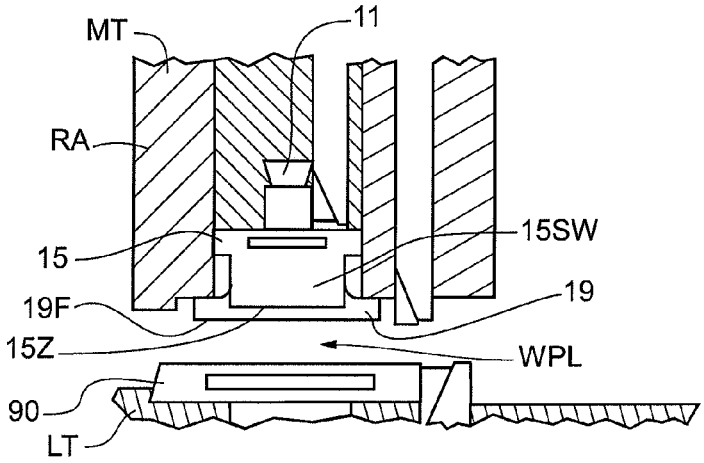
FIG. 18 is a partially broken-away cross-sectional side view of a combination comprising a machine tool and a forming tool in accordance with certain embodiments of the invention, the forming tool being operatively mounted on the machine tool.

In more detail, the present embodiment group provides a forming tool 10 adapted for being mounted removably on a machine tool MT having a punch-mounting position 100, a die-mounting position 900, and a stripper-mounting position 500. Here again, the forming tool 10 preferably comprises a mount portion 11, a tool body 15, and an elongated forming platform 19. In FIGS. 17 and 18, the mount portion 11 is adapted for being retained operatively in an upper portion 102 of the machine tool's punch-mounting position 100, and the tool body 15 is adapted for being retained operatively in a lower portion 108 of the punch-mounting position 100. The illustrated tool body 15 has a front section 15F and a rear section 15R, and the mount portion 11 projects from the tool body's rear section 15R. As already described, the elongated forming platform 19 is adapted to engage and forcibly deform a workpiece 50 by creating a desired form 50F in the workpiece. In the present embodiment group, the elongated forming platform 19 is adapted for being located in the machine tool's stripper-mounting position 500 (at least when the machine tool is at rest). This is the position normally occupied by a stripper plate SP (see FIGS. 13-16).

Thus, certain embodiments provide a combination comprising a machine tool (e.g., a metal-fabricating machine tool) and a forming tool. FIG. 18 shows one exemplary combination. Here, the machine tool MT has a workpiece position WPL, a ram assembly RA above the workpiece position, and a die holder assembly LT below the workpiece position. Preferably, the ram assembly RA is adapted to accelerate the forming tool 10 repeatedly along a pressing axis PA (see FIG. 17). The ram assembly can alternatively be below, or otherwise on one side of, the workpiece position.

In the present embodiments, the ram assembly RA has a punch-mounting position 100 and a stripper-mounting position 500, and the die holder assembly LT has a die-mounting position 900. The forming tool 10 has its mount portion 11 operatively retained in an upper portion 102 of the punch-mounting position 100, while the tool body 15 is operatively retained in a lower portion 108 of the punch-mounting position 100. In the illustrated combination, the tool body 15 has a front section 15F and a rear section 15R, and the mount portion 11 projects upwardly from the tool body's rear section 15R. The illustrated mount portion 11 is a mounting stem comprising a post projecting from the tool body's rear section 15R to a terminal end, and the post has therein formed a mounting notch 13 engaged by the ram assembly RA. These features, however, are optional, and need not be present in all embodiments.

Referring to FIGS. 17 and 18, it can be seen that the elongated forming platform 19 is located in the machine tool's stripper-mounting position 500 (at least when the ram assembly is at rest). As noted above, this position normally is occupied by a stripper plate SP (see FIGS. 13-16).

In the illustrated combination, the ram assembly RA has a bottommost portion facing downwardly toward the workpiece position WPL. The forming tool 10 here is operatively mounted on the machine tool MT such that, when the ram assembly RA is at rest, the front surface 19F of the elongated forming platform 19 is retained at a lower elevation than the ram assembly's bottommost portion. This is best seen in FIG. 18.

In operation, a workpiece 50 is pressed between the forming tool 10 and a corresponding die 90 to create the desired form 50F. In FIGS. 1-9, the forming tool 10 and die 90 are adapted to create a louver in the workpiece. Therefore, the die 90 in these figures has spring-loaded moveable outer portions 90A, 90B, and a fixed inner portion 95H. The fixed inner portion 95H defines a convex forming section 90X and a shearing edge 90S. A rear section 95T of the fixed inner portion 95H is secured in a channel 90CH defined by a base portion 98 of the die 90. The spring-loaded outer portions 90A, 90B are mounted on the die's base portion 98 by a plurality of posts 90P, which are adapted to move (together with the moveable outer portions 90A, 90B) toward the base portion when the forming tool 10 presses a workpiece forcibly against the die. A plurality of springs 90SP mounted between the die's base portion 98 and its outer portions 90A, 90B keep the outer portions in default positions wherein the base 98 and outer portions 90A, 90B are separated by a gap 90G. This is perhaps best seen in FIGS. 1 and 4-7.

Figure 11:
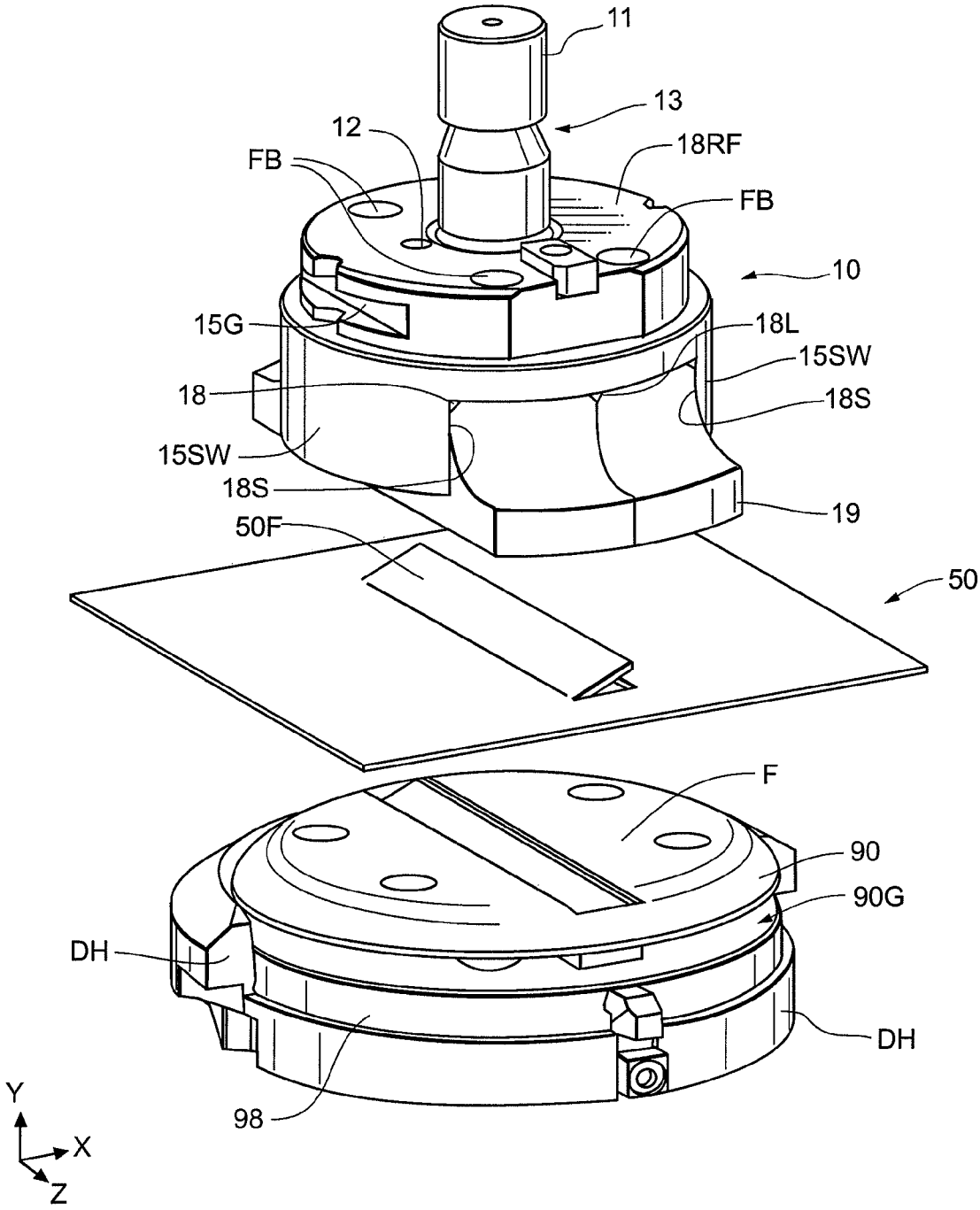
FIG. 11 is an exploded perspective view of a tool set and workpiece in accordance with certain embodiments of the invention.
Figure 12:
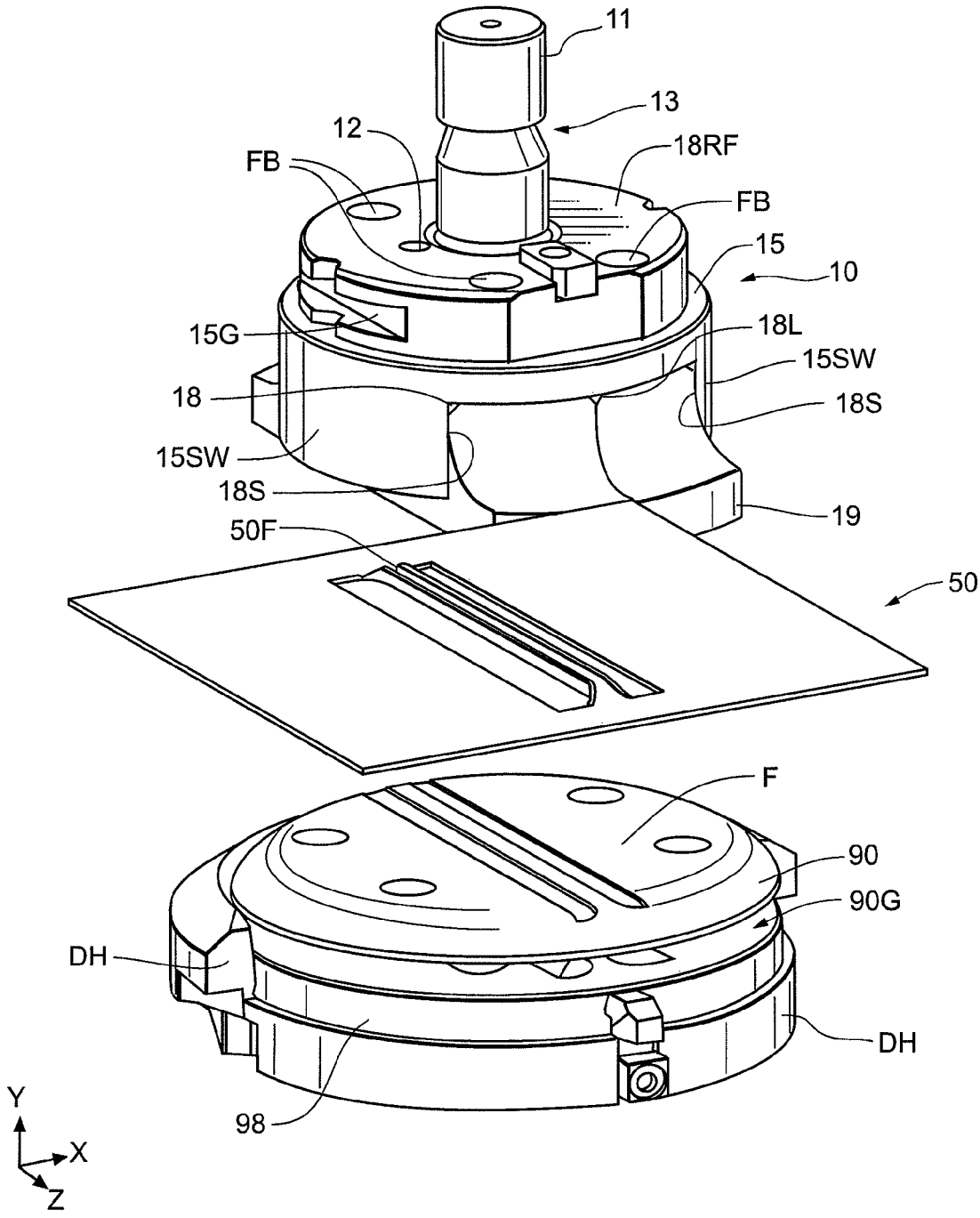
FIG. 12 is an exploded perspective view of a tool set and workpiece in accordance with other embodiments of the invention.
Figure 13:
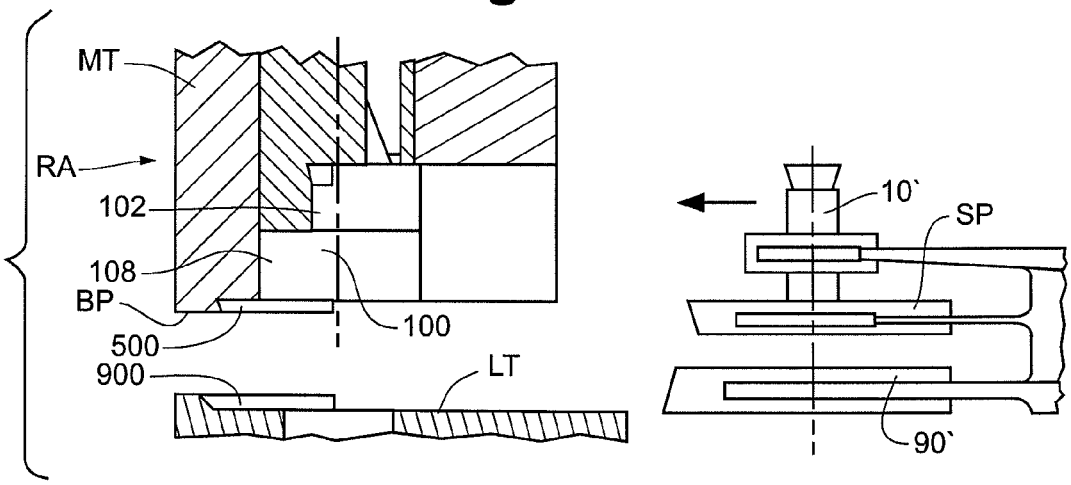
FIGS. 13-16 are partially broken-away cross-sectional side views exemplifying use of a holder cartridge to load a prior art tool set onto a machine tool.
Figure 14:
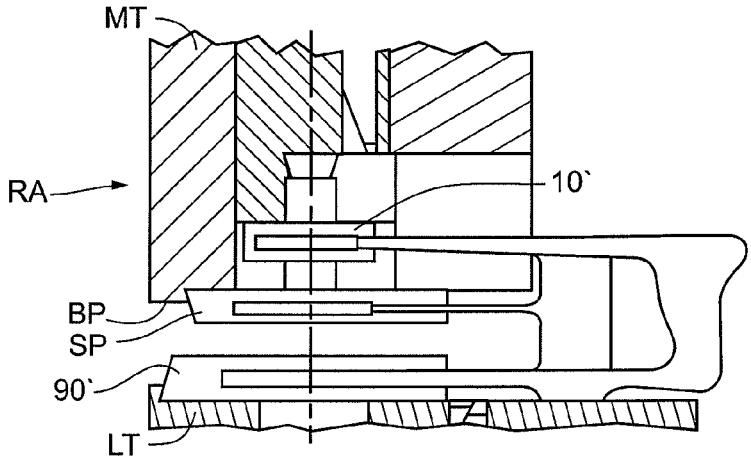
Figure 15:
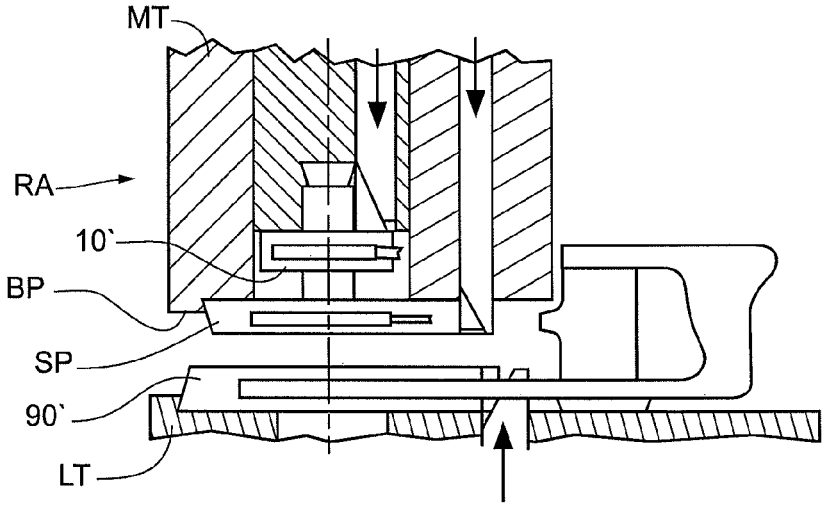
Figure 16:
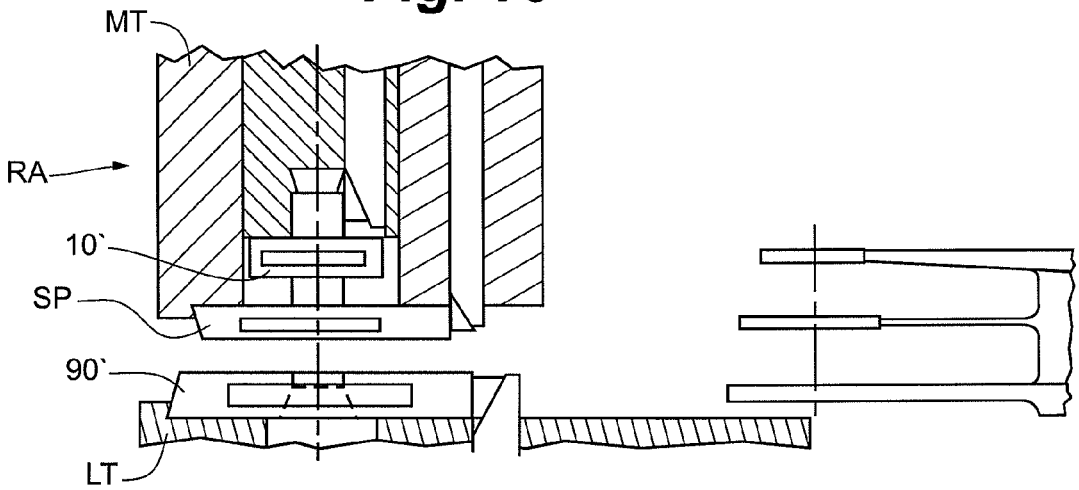

As already explained, the forming tool 10 can be configured to create many different forms 50F. Thus, the die 90 can have a variety of corresponding configurations. Examples include lance & form configurations and card guide configurations, as exemplified by FIGS. 11 and 12, respectively. Skilled artisans will be familiar with other useful configurations. In many cases, the die 90 will have at least one resiliently-mounted (e.g., spring-loaded) moveable portion, and at least one portion that is fixed (i.e., rigidly maintained in a fixed position during forming). FIGS. 11 and 12, for example, show embodiments where the die 90 has a resiliently-mounted moveable outer portion surrounding at least one fixed inner portion.

The dimensions of the die 90 preferably are selected such that the form 50F created with the die has a major dimension of at least 3½ inches, at least 3.65 inches, or at least 3¾ inches, such as about 4 inches or more. Thus, the forming structure 90X (and/or a shearing edge 90S) of the die 90 desirably has a major dimension within one or more of these ranges.

The invention encompasses any method of using the present forming tool (which can have any structure disclosed herein) to create a form in a workpiece. These methods generally involve the workpiece, the forming tool, and a machine tool. Reference is made to FIGS. 1, 11, 12, and 18.

Preferably, the machine tool MT has a workpiece position WPL adapted to receive the workpiece 50. The workpiece can optionally be a sheet-like metal workpiece. The present methods involve positioning the workpiece 50 at the workpiece position WPL. In some cases, the machine tool MT has a ram assembly RA above the workpiece position WPL. As already explained, the ram assembly can alternatively be below (or otherwise to one side of) the workpiece position. For purposes of example, however, the following discussion refers to arrangements where the ram assembly is above the workpiece. The ram assembly RA preferably has a punch-mounting position 100 and a stripper-mounting position 500. In the present example, the machine tool MT has a die holder assembly LT below the workpiece position WPL. (Here again, the die holder assembly can alternatively be above the workpiece, or otherwise to one side of it.) As noted above, the die holder assembly LT has a die-mounting position 900.

In the present example, the forming tool 10 is mounted removably on the machine tool MT. Referring to FIG. 18, the forming tool 10 has a mount portion 11 retained in an upper portion 102 of the machine tool's punch-mounting position 100, and the tool body 15 is retained in a lower portion 108 of the punch-mounting position. In this particular embodiment, the tool body 15 has a front section 15F and a rear section 15R, and the mount portion 11 projects upwardly from the tool body's rear section.

In the present methods, the tool's elongated forming platform 19 is located in the machine tool's stripper-mounting position 500 when the ram assembly RA is at rest. This is shown in FIG. 18. As will be understood by skilled artisans, the illustrated ram assembly RA is adapted to move the forming tool 10 downwardly (e.g., along a pressing axis PA, see FIG. 17) into contact with the workpiece 50.

The present fabrication methods involve operating the machine tool MT so as to actuate the ram assembly RA. This moves the forming tool 10 downwardly into contact with the workpiece, such that the tool's elongated forming platform 19 forcibly deforms the workpiece 50 by creating a desired form 50F in the workpiece. In some cases, the form 50F is selected from the group consisting of a louver, a lance & form, and a card guide. Due to the advantageous design of the forming tool 10, it is possible for the form 50F to have a major dimension of greater than 3½ inches, greater than 3.65 inches, or greater 3¾ inches, such as about 4 inches or more.

In the present example, the ram assembly has a bottommost portion facing downwardly toward the workpiece location. Reference is made to FIG. 18. The elongated forming platform 19 has a front surface 19F that contacts the workpiece 50 during forming operations. And in the present example, the forming tool 10 is mounted operatively on the machine tool MT such that, when the ram assembly RA is at rest (which is the situation shown in FIG. 18), the front surface 19F of the elongated forming platform 19 is at a lower elevation than the ram assembly's bottommost portion.

As noted above, the durable design of the forming tool 10 can advantageously involve the elongated forming platform 19 being rigidly disposed relative to the tool body 15. In such cases, during forming operations, the elongated forming platform 19 and the tool body 15 preferably do not move relative to each other (at least not significantly).

While a preferred embodiment of the present invention has been described, it should be understood that various changes, adaptations and modifications may be made therein without departing from the spirit of the invention and the scope of the appended claims.

What is claimed is:

1. A forming tool adapted for being mounted removably on a machine tool, the forming tool comprising:

a) a mount portion adapted for being retained by a tool holder of the machine tool;

b) a tool body having a front section and a rear section, wherein the mount portion projects from the tool body's rear section, the tool body having a first crosswise major dimension; and c) an elongated forming platform extending from the front section of the tool body, the elongated forming platform being adapted to engage and forcibly deform a workpiece by creating a desired form in the workpiece, the elongated forming platform having a second crosswise major dimension, the second crosswise major dimension being greater than the first crosswise major dimension, the elongated forming platform being rigidly disposed relative to the tool body, such that throughout forming operations the elongated forming platform and the tool body are restrained against any significant movement relative to each other.

2. The forming tool of claim 1 wherein the front section of the tool body has a leading surface that faces the workpiece during forming operations, the elongated forming platform having a front surface that contacts the workpiece during forming operations, the elongated forming platform being a thrust-out platform such that its front surface is spaced forwardly of the tool body's leading surface.

3. The forming tool of claim 1 wherein the front section of the tool body has a transversely extending channel, the elongated forming platform being rigidly mounted in the transversely extending channel.

4. The forming tool of claim 3 wherein the elongated forming platform is adapted to create one type of form in the workpiece, the elongated forming platform being rigidly mounted in the channel in a removable manner such that the elongated forming platform can be removed from the channel after which there can be mounted in the channel a new elongated forming platform adapted to create another type of form in the workpiece.

5. The forming tool of claim 1 wherein the tool body comprises a generally cylindrical block, the first crosswise major dimension being a diameter of the cylindrical block, the second crosswise major dimension being a length of the elongated forming platform, wherein this length is greater than the diameter of the cylindrical block.

6. The forming tool of claim 5 wherein the elongated forming platform is a generally rectangular block.

7. The forming tool of claim 5 wherein the length of the elongated forming platform is greater than the diameter of the cylindrical block by at least ½ inch.

8. The forming tool of claim 7 wherein the length of the elongated forming platform is greater than the diameter of the cylindrical block by at least ¾ inch.

9. The forming tool of claim 5 wherein the length of the elongated forming platform is greater than the diameter of the cylindrical block by about 1 inch or more.

10. The forming tool of claim 1 wherein the mount portion is a mounting stem.

11. The forming tool of claim 10 wherein the mounting stem comprises a post projecting from the body's rear section to a terminal end, the post having therein formed a mounting notch to facilitate its retention by the tool holder of the machine tool.

12. The forming tool of claim 1 wherein the tool is configured such that when the elongated forming platform engages and forcibly deforms the workpiece, the desired form created in the workpiece is selected from the group consisting of a louver, a lance & form, and a card guide.

13. The forming tool of claim 1 wherein the tool is configured such that when the elongated forming platform engages and forcibly deforms the workpiece, the form created in the workpiece has a major dimension of greater than 3½ inches.

14. The forming tool of claim 1 wherein the tool is configured such that when the elongated forming platform engages and forcibly deforms the workpiece, the form created in the workpiece has a length of greater than 3¾ inches.

15. The forming tool of claim 1 wherein the tool is configured such that when the elongated forming platform engages and forcibly deforms the workpiece, the form created in the workpiece has a length of about 4 inches or more.

16. The forming tool of claim 1 wherein the tool body and the mount portion are both defined by a single integral block.

17. The forming tool of claim 16 wherein the elongated forming platform comprises a block that is discrete from, rather than integral to, the tool body.

18. The forming tool of claim 1 wherein the elongated forming platform is anchored rigidly to the tool body by a plurality of fasteners extending between the elongated forming platform and the tool body.

19. The forming tool of claim 2 wherein the front surface of the elongated forming platform is spaced forwardly of the tool body's leading surface by at least 1/16 inch.

20. The forming tool of claim 19 wherein the front surface of the elongated forming platform is spaced forwardly of the tool body's leading surface by at least 3/16 inch.

21. The forming tool of claim 2 wherein the front surface of the elongated forming platform is spaced forwardly of the tool body's leading surface by about ¼ inch or more.

22. The forming tool of claim 1 wherein a single integral block defines both the front and rear sections of the tool body, the rear section having a generally cylindrical configuration with a first diameter, the front section having a generally cylindrical configuration with a second diameter, the first diameter being smaller than the second diameter, such that the rear section of the main body has a smaller cylindrical configuration than the front section, and wherein the mount portion is a mounting stem comprising a post with a diameter that is smaller than the diameter of the tool body's rear section.

23. The forming tool of claim 1 wherein the front section of the tool body has a transversely extending channel, the elongated forming platform comprising two bodies carried alongside each other, both bodies being rigidly mounted in the transversely extending channel such that confronting sides of the bodies are in contact with each other, wherein the confronting side of one of the bodies defines a shearing edge and bounds a generally concave louver recess formed in the other body.

24. A forming tool adapted for being mounted removably on a machine tool having a punch-mounting position, a die-mounting position, and a stripper-mounting position, the forming tool comprising:

a) a mount portion configured for being operatively retained in an upper portion of the machine tool's punch-mounting position;

b) a tool body configured for being operatively retained in a lower portion of the machine tool's punch-mounting position, the tool body having a front section and a rear section, wherein the mount portion projects from the tool body's rear section; and c) an elongated forming platform adapted to engage and forcibly deform a workpiece by creating a desired form in the workpiece, wherein the elongated forming platform is configured for being located in the machine tool's stripper-mounting position, the elongated forming platform being rigidly disposed relative to the tool body, such that throughout forming operations the elongated forming platform and the tool body are restrained against any significant movement relative to each other.

25. The forming tool of claim 24 wherein the front section of the tool body has a leading surface that faces the workpiece during forming operations, the elongated forming platform having a front surface that contacts the workpiece during forming operations, the elongated forming platform being a thrust-out platform such that its front surface is spaced forwardly of the tool body's leading surface.

26. The forming tool of claim 24 wherein the front section of the tool body has a transversely extending channel, the elongated forming platform being mounted rigidly and removably in the transversely extending channel.

27. The forming tool of claim 24 wherein the tool body has a first crosswise major dimension, the elongated forming platform has a second crosswise major dimension, and the second crosswise major dimension is greater than the first crosswise major dimension.

28. The forming tool of claim 27 wherein the tool body comprises a generally cylindrical block, the first crosswise major dimension being a diameter of the cylindrical block, the second crosswise major dimension being a length of the elongated forming platform, wherein this length is greater than the diameter of the cylindrical block.

29. The forming tool of claim 28 wherein the elongated forming platform is a generally rectangular block.

30. The forming tool of claim 28 wherein the length of the elongated forming platform is greater than the diameter of the cylindrical block by at least ½ inch.

31. The forming tool of claim 24 wherein the mount portion is a mounting stem comprising a post projecting from the tool body's rear section to a terminal end, the post having therein formed a mounting notch to facilitate its retention by the machine tool.

32. The forming tool of claim 24 wherein the tool is configured such that when the elongated forming platform engages and forcibly deforms the workpiece, the desired form created in the workpiece is selected from the group consisting of a louver, a lance & form, and a card guide.

33. The forming tool of claim 24 wherein the tool is configured such that when the elongated forming platform engages and forcibly deforms the workpiece, the form created in the workpiece has a major dimension of greater than 3¾ inches.

34. The forming tool of claim 24 wherein a single integral block defines both the front and rear sections of the tool body, the rear section having a generally cylindrical configuration with a first diameter, the front section having a generally cylindrical configuration with a second diameter, the first diameter being smaller than the second diameter, such that the rear section of the main body has a smaller cylindrical configuration than the front section, wherein the elongated forming platform has a partial-cylinder configuration with a diameter that is larger than the diameter of the tool body's front section, and wherein the mount portion is a mounting stem comprising a post with a diameter that is smaller than the diameter of the tool body's rear section.

35. The forming tool of claim 25 wherein the front surface of the elongated forming platform is spaced forwardly of the tool body's leading surface by at least 1/16 inch.

36. The forming tool of claim 24 wherein the front section of the tool body has a transversely extending channel, the elongated forming platform comprising two bodies carried alongside each other, both bodies being rigidly mounted in the transversely extending channel such that confronting sides of the bodies are in contact with each other, wherein the confronting side of one of the bodies defines a shearing edge and bounds a generally concave louver recess formed in the other body.

37. A combination including a machine tool and a forming tool, the forming tool being mounted removably on the machine tool, the machine tool comprising:

a workpiece position;

a ram assembly above the workpiece position, the ram assembly having a punch-mounting position and a stripper-mounting position; and a die holder assembly below the workpiece position, the die holder assembly having a die-mounting position;

the forming tool comprising:

a mount portion retained in an upper portion of the machine tool's punch-mounting position;

a tool body retained in a lower portion of the machine tool's punch-mounting position, the tool body having a front section and a rear section, wherein the mount portion projects upwardly from the tool body's rear section; and an elongated forming platform adapted to engage and forcibly deform a workpiece by creating a desired form in the workpiece, the elongated forming platform being located in the machine tool's stripper-mounting position, the elongated forming platform being rigidly disposed relative to the tool body, such that throughout forming operations the elongated forming platform and the tool body are restrained against any significant movement relative to each other.

38. The combination of claim 37 wherein the ram assembly has a bottommost portion facing downwardly toward the workpiece position, the elongated forming platform having a front surface that contacts the workpiece during forming operations, the forming tool being mounted operatively on the machine tool such that, when the ram assembly is at rest, the front surface of the elongated forming platform is retained at a lower elevation than the ram assembly's bottommost portion.

39. The combination of claim 37 wherein the ram assembly is adapted to accelerate the forming tool repeatedly along a pressing axis.

40. The combination of claim 37 wherein the front section of the tool body has a leading surface that faces the workpiece during forming operations, the elongated forming platform having a front surface that contacts the workpiece during forming operations, the elongated forming platform being a thrust-out platform such that its front surface is spaced forwardly of the tool body's leading surface.

41. The combination of claim 37 wherein the front section of the tool body has a transversely extending channel, the elongated forming platform being mounted rigidly and removably in the transversely extending channel.

42. The combination of claim 37 wherein the tool body has a first crosswise major dimension, the elongated forming platform has a second crosswise major dimension, and the second crosswise major dimension is greater than the first crosswise major dimension.

43. The combination of claim 42 wherein the tool body comprises a generally cylindrical block, the first crosswise major dimension being a diameter of the cylindrical block, the second crosswise major dimension being a length of the elongated forming platform, wherein this length is greater than the diameter of the cylindrical block.

44. The combination of claim 43 wherein the length of the elongated forming platform is greater than the diameter of the cylindrical block by at least ½ inch.

45. The combination of claim 37 wherein the mount portion is a mounting stem comprising a post projecting from the body's rear section to a terminal end, the post having therein formed a mounting notch engaged by the ram assembly.

46. The combination of claim 37 wherein the tool is configured such that when the elongated forming platform engages and forcibly deforms the workpiece, the desired form created in the workpiece is selected from the group consisting of a louver, a lance & form, and a card guide.

47. The combination of claim 37 wherein the tool is configured such that when the elongated forming platform engages and forcibly deforms the workpiece, the form created in the workpiece has a major dimension of greater than 3¾ inches.

48. The combination of claim 37 wherein a single integral block defines both the front and rear sections of the tool body, the rear section having a generally cylindrical configuration with a first diameter, the front section having a generally cylindrical configuration with a second diameter, the first diameter being smaller than the second diameter, such that the rear section of the main body has a smaller cylindrical configuration than the front section, wherein the elongated forming platform has a partial-cylinder configuration with a diameter that is larger than the diameter of the tool body's front section, and wherein the mount portion is a mounting stem comprising a post with a diameter that is smaller than the diameter of the tool body's rear section.

49. The combination of claim 40 wherein the front surface of the elongated forming platform is spaced forwardly of the tool body's leading surface by at least 3/16 inch.

50. A method of fabricating a sheet-like metal workpiece, the method comprising providing a machine tool, a forming tool, and the workpiece, the machine tool comprising:

a workpiece position where the sheet-like metal workpiece is located;

a ram assembly above the workpiece position, the ram assembly having a punch-mounting position and a stripper-mounting position; and a die holder assembly below the workpiece position, the die holder assembly having a die-mounting position;

wherein the forming tool is mounted removably on the machine tool, and the ram assembly is adapted to move the forming tool downwardly into contact with the workpiece;

the forming tool comprising:

a mount portion retained in an upper portion of the machine tool's punch-mounting position;

a tool body retained in a lower portion of the machine tool's punch-mounting position, the tool body having a front section and a rear section, wherein the mount portion projects upwardly from the tool body's rear section; wherein an elongated forming platform of the forming tool is located in the machine tool's stripper-mounting position when the ram assembly is at rest;

the method comprising:

operating the machine tool so as to actuate the ram assembly, thereby moving the forming tool downwardly into contact with the sheet-like metal workpiece such that the forming tool's elongated forming platform forcibly deforms the workpiece by creating a desired form in the workpiece, wherein the elongated forming platform is rigidly disposed relative to the tool body, such that during said forming operation the elongated forming platform and the tool body do not move relative to each other significantly.

51. The method of claim 50 wherein the form created in the workpiece is selected from the group consisting of a louver, a lance & form, and a card guide.

52. The method of claim 50 wherein the form created in the workpiece has a major dimension of greater than 3¾ inches.

53. The method of claim 50 wherein the ram assembly has a bottommost portion facing downwardly toward the workpiece, the elongated forming platform having a front surface that contacts the workpiece during forming operations, the forming tool being mounted operatively on the machine tool such that, when the ram assembly is at rest, the front surface of the elongated forming platform is at a lower elevation than the ram assembly's bottommost portion.

54. The method of claim 50 wherein the front section of the tool body has a leading surface that faces the workpiece during forming operations, the elongated forming platform having a front surface that contacts the workpiece during forming operations, the elongated forming platform being a thrust-out platform such that its front surface is spaced forwardly of the tool body's leading surface.

55. The method of claim 50 wherein the tool body has a first crosswise major dimension, the elongated forming platform has a second crosswise major dimension, and the second crosswise major dimension is greater than the first crosswise major dimension.

56. The method of claim 55 wherein the second crosswise major dimension is greater than the first crosswise major dimension by at least ½ inch.

* * * * *